United States Patent [19]

Braun et al.

[11] 4,375,161

[45] Mar. 1, 1983

[54] DEVICE FOR OPENING FLANGED JOINTS

[75] Inventors: Joerg P. Braun, Stuttgart; Stefan Fritz, Freiberg, both of Fed. Rep. of Germany

[73] Assignee: Sueddeutsche Kuehlerfabrik Julius Fr. Behr GmbH & Co. KG, Stuttgart, Fed. Rep. of Germany

[21] Appl. No.: 256,071

[22] Filed: Apr. 21, 1981

[30] Foreign Application Priority Data

Apr. 23, 1980 [DE] Fed. Rep. of Germany ..... 3015602

[51] Int. Cl.[3] ..... B21D 7/06

[52] U.S. Cl. ..... 72/412; 29/268; 72/453.16

[58] Field of Search ..... 72/453.16, 387, 453.15, 72/453.17, 409, 410, 412; 29/268, 426.5; 81/301

[56] References Cited

U.S. PATENT DOCUMENTS

| | | | |
|---|---|---|---|
| 2,248,166 | 7/1941 | Eilers | 29/268 |
| 2,267,660 | 12/1941 | McPhail | 29/268 |
| 3,366,085 | 1/1968 | Young | 29/268 |
| 3,822,468 | 7/1974 | Mueller . | |
| 4,050,464 | 9/1977 | Hall | 29/628 |
| 4,226,109 | 10/1980 | Nilsson | 72/453.15 |
| 4,281,531 | 8/1981 | Ehmann | 72/453.17 |

FOREIGN PATENT DOCUMENTS

| | | |
|---|---|---|
| 2852415 | 4/1981 | Fed. Rep. of Germany . |
| 2852408 | 10/1981 | Fed. Rep. of Germany . |
| 1184470 | 3/1970 | United Kingdom . |
| 1285770 | 8/1972 | United Kingdom . |
| 1435903 | 5/1976 | United Kingdom . |
| 1468376 | 3/1977 | United Kingdom . |

OTHER PUBLICATIONS

Radiator Reporter and Pricing Guide, vol. 8, No. 9, pp. 80-97-80-101, Sep., 1980.

*Primary Examiner*—Gene Crosby

*Attorney, Agent, or Firm*—Schwartz, Jeffery, Schwaab, Mack, Blumenthal & Koch

[57] ABSTRACT

Disclosed is a device for opening a flanged joint of the type wherein one or more flange extensions on one flange part of the joint are bent around into engagement with the other flange part of the joint. A first leg member including a first generally tapered end portion is adapted to enter behind the bent-around flange extension of the flanged joint and engage the end of the bent-around flange extension. A second leg member includes a first end portion cooperating with the first end of the first leg member and having a generally flat contact surface on its side facing the first end portion of the first leg member, with the flat contact surface being adapted to engage and support the outer circumferential surface of the flanged joint. Preferably, the device includes a fluid cylinder attached to the second ends of the first and second leg members for selectively producing relative rotation of the leg members with respect to each other about a hinge connection.

10 Claims, 2 Drawing Figures

DEVICE FOR OPENING FLANGED JOINTS

BACKGROUND OF THE INVENTION

The present invention relates to a device for opening flanged joints, and more especially to a device for opening flanged joints of the type wherein a flanging flap on one part of the joint is bent around into engagement with the other part of the joint.

Flanged joints, such as those found frequently in the radiators of automotive vehicles, must occasionally be opened for the purpose of repairs, for example, so that the inside becomes accessible and damaged tubing may be sealed off and gaskets replaced. Flanged joints of this type have numerous flanging flaps of the bottom flange bent over the flange of the upper part. The lower part carrying the flanging flaps, namely, the header or tube plate in a radiator, is to be reused following the repairs, and consequently the flanging flaps must not break during the opening, since they are needed for resealing to obtain the necessary sealing force. The opening process thus requires particular care and specially designed tools.

Heretofore, radiators with flanged joints of this type were opened manually and with a tool resembling a screw driver. In the process, the tool was supported on the outside of the radiator tank by its shaft and the tube plate was bent upwardly, in part to an excessive degree. This opening process is laborious and unreliable.

SUMMARY OF THE INVENTION

It is therefore an object of the present invention to provide an improved device for opening flanged joints.

It is also an object of the present invention to provide a device for rapidly and reliably opening joints with flanging flaps without damage to the parts of the flanged joint.

In particular, it is an object of the present invention to provide a device which makes possible the economical and safe opening of flanged joints of automotive radiators for the purpose of repairs.

In accomplishing the foregoing objects, there has been provided in accordance with the present invention a device for opening a flanged joint of the type wherein one or more flange extensions on one flange part of the joint are bent around into engagement with the other flange part of the joint. The device comprises a first elongated leg member; a second elongated leg member; a hinge connection between the first and second leg members at a point intermediate the ends thereof, to form a pliers-like connection between the first and second leg members. The first leg member includes a first generally tapered end portion adapted to enter behind the bent-around flange extension of the flanged joint and engage the end of the bent-around flange extension, and the second leg member includes a first end portion cooperating with the first end of the first leg member and comprising a generally flat contact surface on its side facing the first end portion of the first leg member, with the flat contact surface being adapted to engage and support the outer circumferential surface of the flanged joint. Preferably, the device further comprises means, attached to the second ends of the first and second leg members, for selectively producing relative rotation of the leg members with respect to each other about the hinge connection. Most preferably, the rotation producing means comprises a fluid actuated cylinder, advantageously a compressed air-actuated pneumatic cylinder.

Further objects, features and advantages of the present invention will become apparent from the detailed description of preferred embodiments which follows, when considered together with the attached figures of drawing.

DETAILED DESCRIPTION OF PREFERRED EMBODIMENTS

Figure 1:
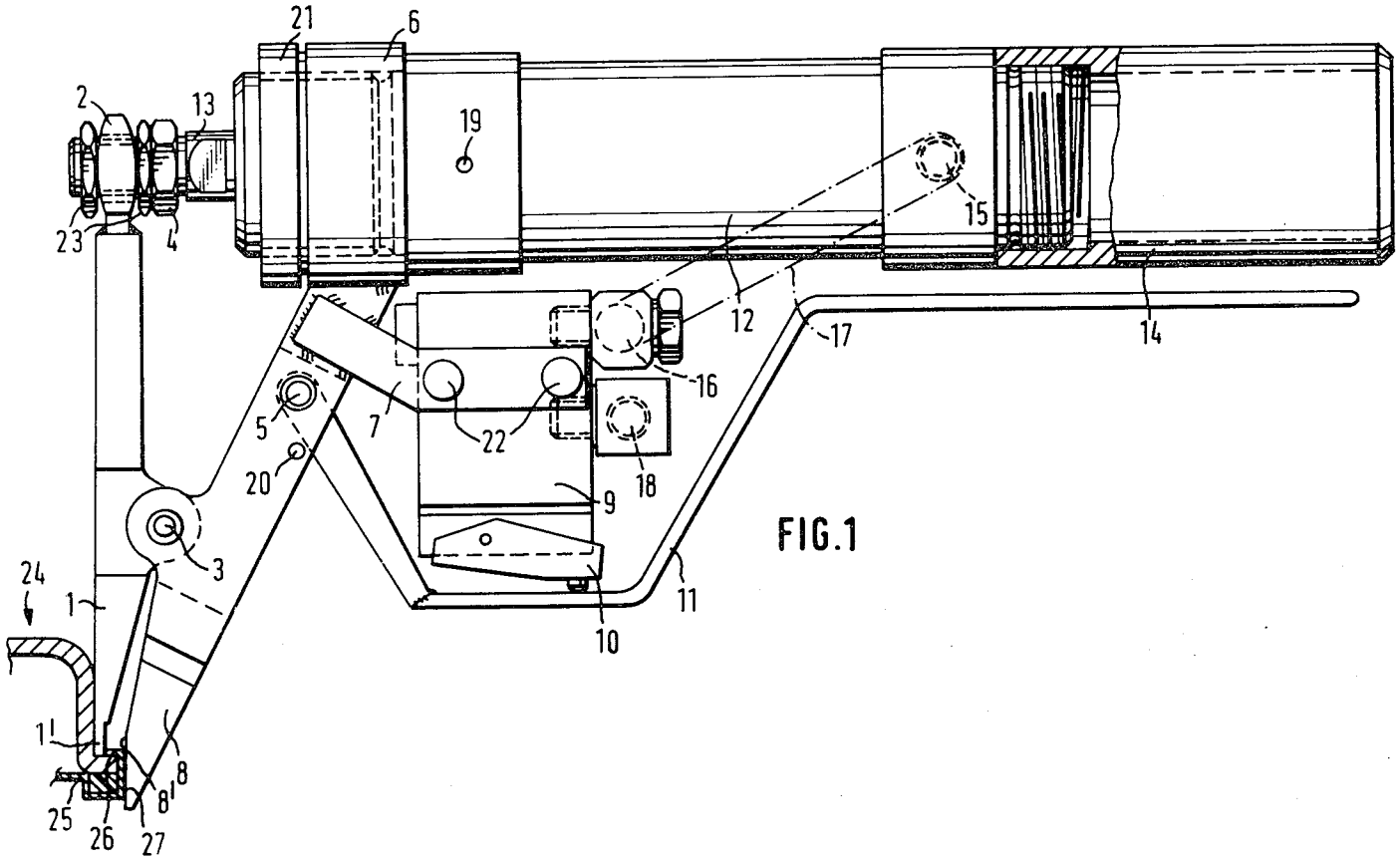
FIG. 1 is a plan view of a device for opening flanged joints according to the present invention, shown in its applied position on a flanged joint of an automotive type radiator.

It is possible with the pliers according to the present invention to open a flanged joint without supporting the tool on the upper part of the joint. The design of the pliers according to the invention absorbs the opening forces within itself. Thus, the second leg of the pliers is supported by its smooth contact surface on the outside of the flanged joint, while the first leg of the pliers grips the flanging flaps from behind with its chisel-like blade and bends them into the vertical position by its movement toward the second leg of the pliers. This prevents breaking of the flanging flaps.

The equalization of forces within the pliers furthermore makes it possible to support the radiator during the repair work, i.e., during the opening process, in a holding device of any type, which has not been feasible in the conventional manual opening method.

According to a further advantageous embodiment of the invention, the legs of the pliers are connected, hingedly on one side and rigidly on the other, with a working cylinder, preferably with a pneumatic cylinder, which provides the force required to open the flanged joint. This provides an economical device affording rapid and easy opening.

According to a further advantageous embodiment of the invention, a control valve is connected with the second leg of the pliers (i.e., the leg rigidly joined with the working cylinder) and the control valve may be actuated by means of a hand lever which is also attached to the second leg. This results in the advantage that the device may be easily and thus rapidly and safely operated by hand.

According to a further advantageous embodiment of the invention, the working cylinder may consist of a compressed air-actuated pneumatic cylinder, which leads to particularly versatile application of the device in every shop. The device according to the invention may be connected by means of a compressed air hose with a suitable, readily-available source of compressed air.

The invention is illustrated in the drawings with the aid of an exemplary embodiment and shall be described in more detail hereinbelow.

The essential elements according to the invention are the two legs 1 and 8 of the pliers; they are hingedly connected with each other by means of the hinge pin 3. At its end facing the radiator 24, the first plier leg has a chisel-like blade 1' designed to fit exactly into the space between the flanging flap 26 and the radiator tank of the radiator 24. The second plier leg 8 is provided with a smooth contact surface 8', resting against the outer surface 27 of the tube plate of the radiator 24. This contact surface 8' is extended upwardly so that the flanging flap 26 will not be bent too far, but will be set up in a vertical position.

Figure 2:
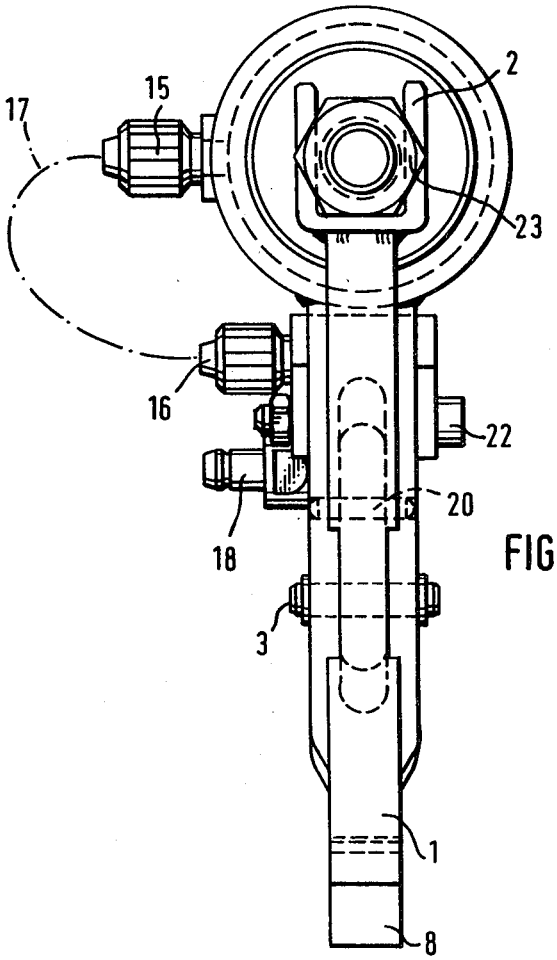
FIG. 2 is a left side end view of the device shown in FIG. 1.

Pliers designed in this manner, consisting of the first and the second plier legs and connected with each other by a hinge pin 3, may in principle be actuated manually, if the other ends of the legs are designed accordingly as hand grips. This, however, is not the case in the embodiment illustrated herein, but instead the legs are actuated by a pneumatic cylinder 12. According to the illustrated embodiment, the first plier leg 1 is hingedly connected with the piston rod 13 of the pneumatic cylinder 12 by means of a fork 2 (FIG. 2) engaging the annular groove of an adjusting screw 23, which is secured by the lock nut 4. The second plier leg 8 is welded to a ring 6, which in turn is placed over the forwardly extended end of the pneumatic cylinder 12 and is fastened to it by means of a sleeve nut 21. This results in a rigid, i.e., rigid with respect to bending, clamping of the leg 8 of the pliers in relation to the pneumatic cylinder 12. The second plier leg 8 further carries a support arm 7, to which the control valve 9 for the compressed air together with the control lever 10 therefor are fastened by means of two screws 22. The hand lever 11 for actuating the compressed air supply is hingedly mounted on the second plier leg 8 by means of a bolt 5. The hand lever is secured in a first terminal position by the stop pin 20, and a second terminal position results from rotating the manual lever 11 about bolt 5, whereby the hand lever actuates an offset part of the valve control lever 10 and thus the valve 9.

The valve 9 carries the compressed air inlet 18, provided in the form of a coupling element for a compressed air hose. On the control valve 9 there is further provided a compressed air outlet 16, which is connected through compressed air hose 17 with the compressed air fitting 15 of the pneumatic cylinder 12. The pneumatic cylinder 12 carries inside a conventional piston, not shown, with a piston rod, which protrudes as the piston rod 13 from the pneumatic cylinder 12. Such pneumatic cylinders are commercially available. The valve 9, designed as a 3/2-way compressed air control valve, is similarly commercially available with respect to its internal and external layout. Finally, an air pressure release orifice 19 is provided on the pneumatic cylinder 12.

The device according to the invention operates in the following manner:

The radiator 24 is initially set up in a vertical position or held in this position in a suitable jig. In the illustrated example, the radiator has a synthetic plastic radiator tank with a flange 25, over which the flanging flaps 26 of the tube plate are bent. This joint between the tank and the plate has a vertical outer surface 27. The pliers device according to the invention is now placed on the flanged joint, so that the blade 1' of the moving plier leg 1 enters the space between the tank and the flanging flap 26, while the contact surface 8' of the stationary plier leg 8 rests on the outer surface 27 of the tube plate of the radiator 24. The device is actuated by the manual actuation of the hand lever 11 on the pneumatic cylinder, whereby the valve switch 10 opens the compressed air valve 9 and compressed air enters the pneumatic cylinder 12, thereby displacing the piston rod 13 in FIG. 1 to the left. The movement of the piston rod 13 out of the pneumatic cylinder 12 causes the blade 1' of the moving plier leg 1 to move toward the contact surface 8' of the stationary plier leg 8', and the flanging flap 26 is thereby bent into a vertical position. The contact surface 8' prevents the overbending of the flanging flap 26. Release of the hand lever 11 closes the compressed air valve, and the piston rod 13 returns as the result of the action of a return spring, not shown, in the pneumatic cylinder into its original position, i.e., the position shown in FIG. 1. The device is then set onto the next flanging flap in a similar manner, and the opening work step is repeated.

The device according to the invention thus affords an easy, rapid and uniform opening without damage or breaking off of the flanging flaps. Because of the fact that the forces required for the opening of the flanged joint are balanced within the pliers, i.e., by means of the hinge pin 3, the tank of the radiator 24 is not stressed in any way and is therefore not damaged. To ease the task of the operator, the device may be suspended from a spring pull, which absorbs a large part of the weight.

The device according to the invention may further be used with advantage for flange-like joints which do not have conventional flanging flaps, for example, for clamping connections according to the published German patent applications No. 28 52 408.5 and No. 28 52 415.4 belonging to the assignee of the present application.

The cylinder portion of the pneumatic cylinder 12 may also include an axial extension 14, and with the distal end of hand lever 11 arranged parallel to this axial extension, a particularly convenient arrangement is provided for the user of the device.

What is claimed is:

1. A device for opening a flanged joint of the type wherein one or more flange extensions on one flange part of the joint are bent around into engagement with the other flange part of the joint, said device comprising:

a first elongated leg member;

a second elongated leg member;

a hinge connection between said first and second leg members at a point intermediate the ends thereof, to form a pliers-like connection between said first and second leg members;

said first leg member including a first generally narrowed end portion adapted to enter behind the bent-around flange extension of the flanged joint and engage the end of the bent-around flange extension;

said second leg member including a first end portion cooperating with the first end of said first leg member and comprising a generally flat contact surface on its side facing said first end portion of said first leg member, said flat contact surface being adapted to engage and support the outer circumferential surface of the flanged joint;

means, attached to the second ends of said first and second leg members, for selectively producing relative rotation of said leg members with respect to each other about said hinge connection, said rotation producing means comprising a fluid actuated cylinder including a piston rod, said first leg member including a fork in its second end engaging with said piston rod to produce a hinged connection therebetween, and said second end of said second leg member being rigidly connected to said cylinder; and a fluid control valve rigidly connected with said second arm member, said control valve having an inlet and an outlet for a working fluid of said cylinder, said cylinder also including an inlet for said working fluid, and a hose connecting said valve outlet with the working fluid inlet of said cylinder, wherein said control valve includes a valve actuating member and wherein said device further comprises a manual lever hingedly attached to the second leg member for selectively actuating said valve actuating member.

2. A device according to claim 1, wherein said first leg member is arranged approximately at right angles to the longitudinal axis of said piston rod and said second leg member is hingedly connected at an acute angle with respect to said first leg member.

3. A device according to claim 1 wherein said cylinder includes an axial extension and wherein the distal end of said manual lever is arranged parallel to said axial cylinder extension.

4. A device according to claim 1, wherein said cylinder comprises a compressed air-actuated pneumatic cylinder and the control valve comprises a 3/2-way compressed air control valve.

5. A device for opening a crimped connection between a tank and a header in a radiator, the crimped connection having a flanged joint of the type wherein one or more flange extensions on one flange part of the joint are bent around into engagement with the other flange part of the joint, said device comprising:

a first elongated leg member having first and second ends;

a second elongated leg member having first and second ends;

said first leg member including a generally narrowed portion at said first end adapted to enter behind the bent-around flange extension of the flanged joint and engage the end of the bent-around flange extension;

a pivoting connection between said first and second leg members at a point intermediate the ends thereof, said pivoting connection causing the first end of said first leg member to move toward the first end of said second leg member when the second end of said first leg member is moved away from the second end of said second leg member, whereby the flange extension is deformed; and the first end of said second leg member cooperating with the first end of said first leg member and comprising a generally flat contact surface on its side facing said narrowed portion of said first leg member, said flat contact surface including a first surface portion adapted to engage and be supported on the outer circumferential surface of the flange joint and a second surface portion adapted to serve as a limiting surface against which the flange extension is deformed upon movement of the first end of said first leg member toward said flat contact surface, whereby damage to the tank and over-deformation of the flange extensions are prevented.

6. A device according to claim 5, further comprising means, attached to the second ends of said first and second leg members, for selectively producing relative rotation of said leg members with respect to each other about said hinge connection.

7. A device according to claim 6, wherein said rotation producing means comprises a fluid actuated cylinder including a piston rod, said first leg member includes a fork in its second end engaging with said piston rod to produce a hinged connection therebetween, and said second end of said second leg member is rigidly connected to said cylinder.

8. A device according to claim 7, wherein said first leg member is arranged approximately at right angles to the longitudinal axis of said piston rod and said second leg member is hingedly connected at an acute angle with respect to said first leg member.

9. A device according to claim 7, further comprising a fluid control valve rigidly connected with said second arm member, said control valve having an inlet and an outlet for a working fluid of said cylinder, said cylinder also including an inlet for said working fluid, and a hose connecting said valve outlet with the working fluid inlet of said cylinder.

10. A device according to claim 9, wherein said control valve includes a valve actuating member and wherein said device further comprises a manual lever hingedly attached to the second leg member for selectively actuating said valve actuating member.

* * * * *